US009894746B2

(12) United States Patent
Norling et al.

(10) Patent No.: US 9,894,746 B2
(45) Date of Patent: Feb. 13, 2018

(54) TARGET WINDOWS FOR ISOTOPE SYSTEMS

(75) Inventors: Jonas Ove Norling, Uppsala (SE); Karin Granath, Uppsala (SE)

(73) Assignee: General Electric Company, Schenectady, NY (US)

( * ) Notice: Subject to any disclaimer, the term of this patent is extended or adjusted under 35 U.S.C. 154(b) by 675 days.

(21) Appl. No.: 13/436,222

(22) Filed: Mar. 30, 2012

(65) Prior Publication Data

US 2013/0259180 A1 Oct. 3, 2013

(51) Int. Cl.
*H05H 6/00* (2006.01)

(52) U.S. Cl.
CPC ..... *H05H 6/00* (2013.01)

(58) Field of Classification Search
CPC ..... G21G 1/10; G21G 1/00; H05H 6/00
USPC ..... 376/190, 194, 195, 151; 250/305
See application file for complete search history.

(56) References Cited

U.S. PATENT DOCUMENTS

| | | | |
|---|---|---|---|
| 4,364,898 | A | 12/1982 | Meyer et al. |
| 5,521,469 | A | 5/1996 | Laisne |
| 6,057,655 | A | 5/2000 | Jongen |
| 6,392,246 | B1 | 5/2002 | Wiberg et al. |
| 6,417,634 | B1 | 7/2002 | Bergstroem |
| 6,433,495 | B1 | 8/2002 | Wiberg |
| 7,122,966 | B2 | 10/2006 | Norling et al. |
| 7,466,085 | B2 | 12/2008 | Nutt |
| 7,476,883 | B2 | 1/2009 | Nutt |
| 8,288,736 | B2 | 10/2012 | Amelia et al. |
| 2005/0201504 | A1 | 9/2005 | Zeisler et al. |
| 2005/0283199 | A1 | 12/2005 | Norling et al. |
| 2006/0062342 | A1* | 3/2006 | Gonzalez Lepera et al. ..... 376/195 |
| 2007/0040115 | A1* | 2/2007 | Publicover ..... G01T 1/29 250/305 |
| 2009/0052628 | A1* | 2/2009 | Wilson ..... G21G 1/10 378/143 |
| 2009/0090875 | A1 | 4/2009 | Gelbart et al. |
| 2010/0282978 | A1 | 11/2010 | Norling et al. |
| 2010/0282979 | A1 | 11/2010 | Norling et al. |
| 2010/0283371 | A1 | 11/2010 | Norling et al. |

(Continued)

FOREIGN PATENT DOCUMENTS

| | | | |
|---|---|---|---|
| CN | 1922695 | A | 2/2007 |
| EP | 2146555 | A1 | 1/2010 |

(Continued)

OTHER PUBLICATIONS

Galiano, Eduardo, and Roy S. Tilbury. "The Cyclotron Production of Carrier-free 77Br via the 79Br (p, 3n) 77Kr-> 77Br Reaction using a Liquid Target and On-line Extraction." Applied radiation and isotopes 49.1 (1998): 105-111.*

(Continued)

*Primary Examiner* — Jack W Keith
*Assistant Examiner* — Lily C Garner
(74) *Attorney, Agent, or Firm* — Dean D. Small; The Small Patent Law Group, LLC

(57) ABSTRACT

Target windows for isotope production systems are provided. One target window includes a plurality of foil members in a stacked arrangement. The foil members have sides, and wherein the side of a least one of the foil members engages the side of at least one of the other foil members. Additionally, at least two of the foil members are formed from different materials.

23 Claims, 8 Drawing Sheets

(56) References Cited

U.S. PATENT DOCUMENTS

| | | | |
|---|---|---|---|
| 2010/0329406 | A1 | 12/2010 | Norling et al. |
| 2011/0255646 | A1 | 10/2011 | Eriksson et al. |

FOREIGN PATENT DOCUMENTS

| | | | |
|---|---|---|---|
| JP | S57147799 | U | 9/1982 |
| JP | S57151600 | U | 9/1982 |
| JP | S58117100 | U | 8/1983 |
| JP | 2005517151 | A | 6/2005 |
| JP | 2007101193 | A | 4/2007 |
| JP | 2010530965 | A | 9/2010 |
| WO | 2003099374 | A2 | 12/2003 |
| WO | 2005/122654 | A1 | 12/2005 |
| WO | 2007/016783 | A1 | 2/2007 |

OTHER PUBLICATIONS

Proton Beam Monitoring via (p,xn) Reactions in Niobium. M.A. Avila-Rodriguez, et al. 12th International Workshop on Targetry and Target Chemistry. Jul. 21-24, 2008. p. 57.*

Galiano, Eduardo, and Roy S. Tilbury. "The cyclotron production of carrier-free 77 Br via the 79 Br (p, 3n) 77 Kr→77 Br reaction using a liquid target and on-line extraction." Applied radiation and isotopes 49.1 (1998): 105-111. <http://www.sciencedirect.com/science/article/pii/S0969804397001760>.*

Avila-Rodriguez. Proton Beam Monitoring via (p,xn) Reactions in Niobium. 12th International Workshop on Targetry and Target Chemistry. Jul. 21-24, 2008. pp. 57-59.*

Guillaume, Marcel, et al. "Recommendations for fluorine-18 production." International Journal of Radiation Applications and Instrumentation. Part A. Applied Radiation and Isotopes 42.8 (1991): 749-762.*

Radioisotopes, IAEA, and Radiopharmaceuticals Series No. "4, Cyclotron Produced Radionuclides: Operation and Maintenance of Gas and Liquid Targets." (2012). pp. 11 and 50-51. available online: <http://www-pub.iaea.org/MTCD/Publications/PDF/Pub1563_web.pdf>.*

J.S. Wilson, et al., Niobium Sputtered Havar Foils for the High-Power Production of Reactive [18F] Fluoride by Proton Irradiation of [18O] H2O Targets, Science Direct, Applied Radiation and Isotopes 66 (2008) 565-570.

D. Ferguson, et al., Measurement of Long Lived Radioactive Impurities Retained in the Disposable Cassettes on the Tracerlab MX System During the Production of [18F] FDG, Appl. Radiat. Isotopes (2011), doi:10.1016/j.apradiso.2011.05.028.

R. Johnson, et al., Niobium Sputtered Havar Foils for FDG Production, Edmonton PET Centre, 2 University of Alberta, Edmonton, AB, 1 Advanced Cyclotron Systems, Richmond, BC Canada, (1) pg.

John P. Greene, The Alchemy of Target Making, Notre Dame Physics Seminar, Aug. 4, 2004, Physics Division Argonne National Laboratory, A U.S. Department of Energy, Office of Science Laboratory, Operated by the University of Chicago, (35) pgs.

Search Report and Written Opinion from PCT Application No. PCT/US2013/027709 dated Oct. 29, 2013.

Unofficial English translation of Office Action issued in connection with corresponding CN Application No. 201380018275.1 dated Apr. 26, 2016.

Unofficial English Translation of Japanese Office Action issued in connection with corresponding JP Application No. 2015-503213 dated Jan. 24, 2017.

Unofficial English Translation of Japanese Search Report issued in connection with corresponding JP Application No. 2015-503213 dated Feb. 21, 2017.

* cited by examiner

TARGET WINDOWS FOR ISOTOPE SYSTEMS

BACKGROUND OF THE INVENTION

The subject matter disclosed herein relates generally to isotope production systems, and more particularly to target windows for isotope production systems.

Radioisotopes (also called radionuclides) have applications in medical therapy, imaging, and research, as well as other applications that are not medically related. Systems that produce radioisotopes typically include a particle accelerator, such as a cyclotron, that has a magnet yoke that surrounds an acceleration chamber. Electrical and magnetic fields may be generated within the acceleration chamber to accelerate and guide charged particles along a spiral-like orbit between the poles. To produce the radioisotopes, the cyclotron forms a beam of the charged particles and directs the particle beam out of the acceleration chamber and toward a target system having a target material (also referred to as a starting material). The particle beam is incident upon the target material thereby generating radioisotopes.

In these isotope production systems, such as a Positron Emission Tomography (PET) cyclotron, a target window is provided between a high energy particle entrance side and a target material side of the target system. The target window needs to be capable of withstanding rupture under conditions of high pressure and high temperature. Conventional systems typically use a Havar foil to form this window. However, Havar foil activates with long lived radioactive isotopes. For certain target types, especially water targets, the target media is in direct contact with the foil and the long lived radioactive isotopes are transferred to the target media. The target media is normally processed before injection to a patient that removes the isotopes, but in some applications the isotopes will be injected in the patient, which can be harmful to the patient.

BRIEF DESCRIPTION OF THE INVENTION

In accordance with various embodiments, a target window for an isotope production system is provided that includes a plurality of foil members in a stacked arrangement. The foil members have sides, and wherein the side of a least one of the foil members engages the side of at least one of the other foil members. Additionally, at least two of the foil members are formed from different materials.

In accordance with other various embodiments, a target for an isotope production system is provided that includes a body configured to encase a target material and having a passageway for a charged particle beam. The target also includes a target window between a high energy particle entrance side and a target material side. The target window includes a plurality of foil members in a stacked arrangement, wherein sides of different ones of the plurality of foil members engage one another. Additionally, at least two of the plurality of foil members has different material properties.

In accordance with yet other embodiments, an isotope production system is provided that includes an accelerator including a magnet yoke and having an acceleration chamber. The isotope production system also includes a target system located adjacent to or a distance from the acceleration chamber, wherein the cyclotron is configured to direct a particle beam from the acceleration chamber to the target system. The target system has a body configured to hold a target material and a target window within the body between a high energy particle entrance side and a target material side. The target window includes a plurality of foil members in a stacked arrangement, wherein sides of different ones of the plurality of foil members engage one another and at least two of the plurality of foil members has different material properties.

DETAILED DESCRIPTION OF THE INVENTION

Figure 1:
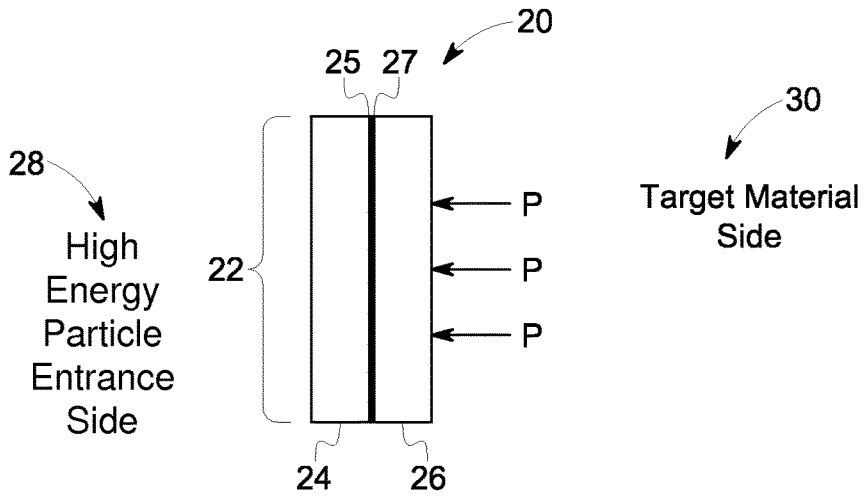
FIG. 1 is a block diagram illustrating a target window formed in accordance with various embodiments.

The foregoing summary, as well as the following detailed description of certain embodiments will be better understood when read in conjunction with the appended drawings. To the extent that the figures illustrate diagrams of the blocks of various embodiments, the blocks are not necessarily indicative of the division between hardware. Thus, for example, one or more of the blocks may be implemented in a single piece of hardware or multiple pieces of hardware. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Various embodiments provide a multi-member target window for isotope production systems, such as for producing isotopes used for medical imaging (e.g., Positron Emission Tomography (PET) imaging). It should be noted that the various embodiments may be used in different types of particle accelerators, such as a cyclotron or linear accelerator. Additionally, various embodiments may be used in different types of radioactive actuator systems other than isotope production systems for producing isotopes for medical applications. By practicing various embodiments, the amount of long lived isotopes produced in the target media (e.g., water) are reduced or eliminated. It should be noted that long-lived isotopes are generally radioisotopes that have very long half-lives, namely that remain radioactive for long periods. In some embodiments, the long-lived isotopes are isotopes that have half-lives of several months or longer. In other embodiments, the long-lived isotopes are isotopes that have half-lives of several years or longer. However, long-lived isotopes having shorter or longer half-lives also may be provided.

In accordance with some embodiments, a target window arrangement is provided that includes a plurality of foils (e.g., two or more foils). The foils in various embodiments have different properties or characteristics. More particularly, as shown in FIG. 1, a target window 20, such as for an isotope production system may be provided that includes a multi-member window structure 22. For example, in one embodiment, the multi-member window structure 22 is formed from two foil members 24 and 26 to define a dual-foil target window. However, additional members may be provided as desired or needed. Additionally, the relative sizes, thicknesses and materials of the foil members 24 and 26 may be varied as desired or needed and as described in more detail herein.

The foil members 24 and 26 in various embodiments are separate foils or members aligned in an abutting arrangement as described in more detail herein. Thus, the foil members 24 and 26 are separately formed or discrete components or elements that are arranged in a stacked arrangement in various embodiments. For example, the foil members 24 and 26 may define separate layers wherein one surface (e.g., a planar face) or side 25 of one of the foil members 24 and 26 engages one surface or side 27 of the other one of the foil members 24 and 26 in a stacked or abutting arrangement.

In the illustrated embodiment, the foil member 24 is positioned on a high energy particle entrance side 28 of the isotope production system (e.g., high energy particles or other particles enter the target window 20 on this side) and the foil member 26 is positioned on a target material side 30 of the isotope production system, which in various embodiments is a water target. As can be seen, a pressure force exists from the target material side 30 to the high energy particle entrance side 28 (illustrated by the P arrows) resulting from the vacuum force on the high energy particle entrance side 28 and the pressure force on the target material side 30. For example, in one embodiment, the pressure force on the target material side 30 is 5-30 times the force on the high energy particle entrance side 28. It should be noted that the high energy particle entrance side 28 may be configured differently in different systems. For example, configuration of the high energy particle entrance side 28 may be a vacuum side or a vacuum and helium side, among other configurations.

The materials forming the foil members 24 and 26 in various embodiments are selected based on desired or needed properties or characteristics. For example, in some embodiments, the foil member 24 is formed from a material that provides a needed strength to resist high pressure and high temperature conditions, such as an alloy disc formed from a heat treatable cobalt base alloy, such as Havar. Havar has a nominal composition of Co (42%), Cr (19.5%), Ni (12.7%), W (2.7%), Mo (2.2%), Mn (1.6%), C (0.2%), Fe balance. In one embodiment, for example, the foil member 24 has a tensile strength of at least 1000 MPa (mega-Pascals). The foil member 26 in some embodiments is formed from a material that has a particular characteristic, such as minimizing the transfer of long-lived radioactive isotopes to the target media or that includes chemically inert materials in contact with a target media, such as a Niobium material. However, other materials may be used, for example, Titanium or Tantalum. Thus, in one embodiment, one foil member, namely the foil member 24 provides strength for the multi-member window structure 22 to resist the vacuum force and the other foil member, namely the foil member 26 reduces the production of long-lived isotopes. In this embodiment, the foil member 24 is positioned towards or on the high energy particle entrance side 28 and the foil member 26 is positioned towards or on the target material side 30.

It should be noted that different materials may be used or selected based on a particular property or characteristic, which may include additional foil member. For example, to provide heat dissipation or heat transport, one of the members 24 and 26 or an additional member is formed from aluminum or other heat dissipating or transport material, such as copper. The aluminum member (or other dissipation or heat transport member) may be added, which may positioned between the first and second members 24 and 26 in one embodiment, such as between the Havar and Niobium members. However, in other embodiments, the foils member may be stacked differently. It also should be noted that the different members may be arranged or stacked to obtain desired or required overall properties based on the specific properties or characteristics of the members. Thus, in one embodiment, the Havar material provides strength, the Niobium material provides chemically inert properties and the optional member formed from aluminum material provides thermal properties, such as heat dissipation. However, in other embodiments, a higher strength material is used, which may be Havar, a material having properties similar to Havar or a material having properties different than Havar. In still other embodiments, a higher strength foil member is not provided. For example, in one embodiment, a Havar foil member is not provided. In addition to the material used, the thickness of the members may be varied, such as based on the energy of the system or other parameters.

In various embodiments, the different foil members are formed or configured based on a particular parameter of interest. For example, some properties may include:

Thermal conductivity;

Tensile strength;

Chemical reactivity (inertness);

Energy degradation properties to which the material is subject;

Radioactive activation; and/or

Melting point.

Accordingly, different members may be formed or stacked in different orders to obtain different properties or characteristics.

Figure 2:
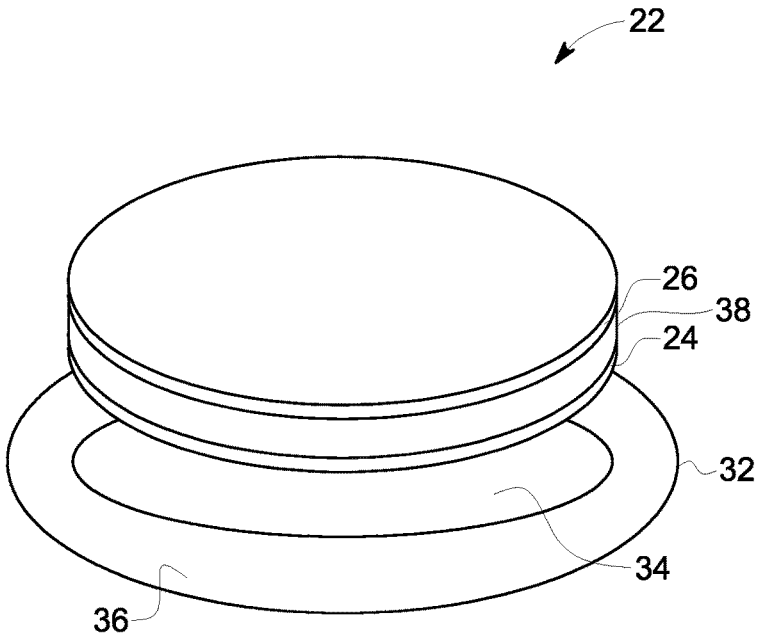
FIG. 2 is a diagram of a target window formed in accordance with one embodiment.

The foil members 24 and 26 may be configured having a different shape or size. For example, the foil members 24 and 26 may be foil discs aligned in a stacked arrangement as shown in FIG. 2, which also illustrates an optional member 38, for example, an aluminum member. The foil members 24 and 26 are generally aligned in a stacked or sandwiched arrangement and held in place, such as against a frame 32 by the pressure force difference between the high energy particle entrance side 28 and the target material side 30. The frame generally includes an opening therethrough 34 that together with the foil members 24 and 26 define the target window 20. Accordingly, the higher pressure side foil, illustrated as the foil member 26 in FIG. 1 is pressed against the lower pressure side foil, illustrated as the foil member 24 in FIG. 1, which is pressed against the frame 32, such as to a support area 36 (e.g., a rim) of the frame 32. Accordingly, the foil member 24 provides a back support structure for the foil member 26.

The foil members 24 and 26, as well as the member 38 may have different thicknesses. For example, in one embodiment, the foil member 24 is formed from Havar and has a thickness of about 5-200 micrometers (microns) (e.g., 25-50 microns) and the foil member 26 is formed from Niobium and has a thickness of about 5-200 microns (e.g., 5-20 microns, such as 10 microns). If the optional member 38 is included, in one embodiment, the member 38 is formed from aluminum and has a thickness of about 50-300 microns. However, the thicknesses may be varied as desired or needed, for example, depending on the energy produced by the system. For example, in some embodiments, the various foil members range in thickness from about 5 microns to about 300 microns, for example, based on the energy of the system of as otherwise desired or required. However, the foil members may have greater or lesser thicknesses, for example, up to 400 microns or greater. The foil members also may have the same or different thicknesses.

Additionally, the material compositions of the various members, for example, the foil members 24 and 26 may be varied. For example, the foil members 24 and 26 may be formed from a combination of materials, such as a composite material to provide certain properties or characteristics, as well as different alloys. As another example, the foil members 24 and 26 may be formed from materials having different grain sizes. Additionally, two or more of the members may be formed from the same material or a single member may be formed from different sub-members having the same or different material(s).

Figure 3:
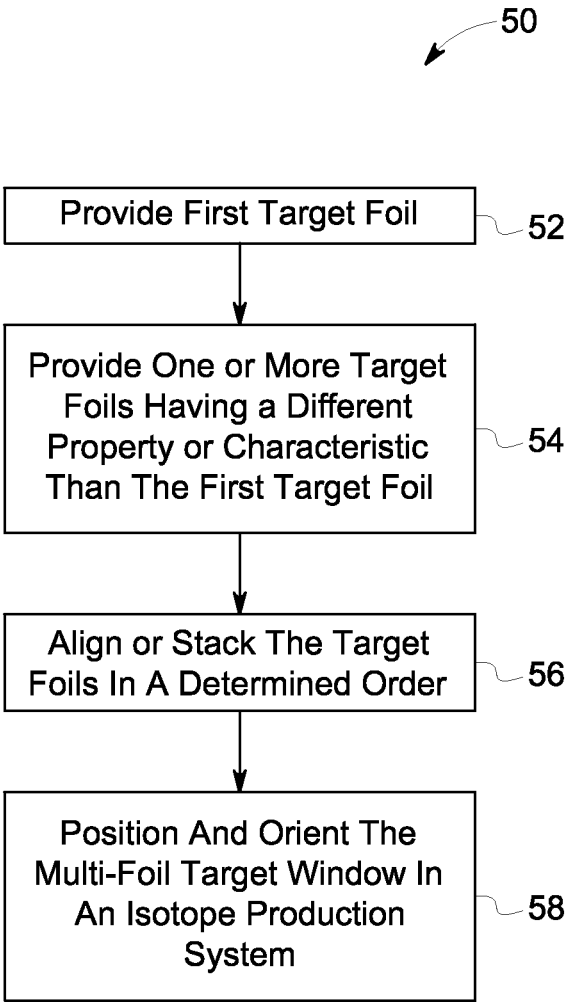
FIG. 3 is a flowchart of a method for forming a target window in accordance with various embodiments.

A method 50 for forming a target window in accordance with various embodiments is shown in FIG. 3. The target window may be used, for example, in an isotope production system having a particle accelerator used to produce one or more radioisotopes, for example, 13N-ammonia. The method 50 includes providing a first target foil at 52. The first target foil provides one or more properties or characteristics, such as a particular tensile strength and melting point. For example, in one embodiment, a Cobalt based alloy foil, such as Havar may be used. The first target member in various embodiments has a tensile strength of at least 1000 MPa and a melting point of at least 1200 degrees Celsius. However, in other embodiments, materials with greater or lesser tensile strength or melting point may be used.

The method 50 also includes providing one or more target foils at 54. At least one of the additional target foils has a different property or characteristic than the first target foil, such as a different property of interest. For example, in one embodiment, the second target foil is formed from material that is chemically inert, such as Niobium. Additional target foils also may be provided, such as a foil having thermal dissipation properties, for example, an aluminum foil.

The thicknesses of the different foils may be determined based on different parameters, such as the energy of the isotope production system or an overall desired property. Additionally, if a member is formed from an alloy or composite, the quantity of different materials also may be varied. In various embodiments, the materials for each of the foils may be determined or selected based on different parameters of interest as described in more detail herein.

Figure 4:
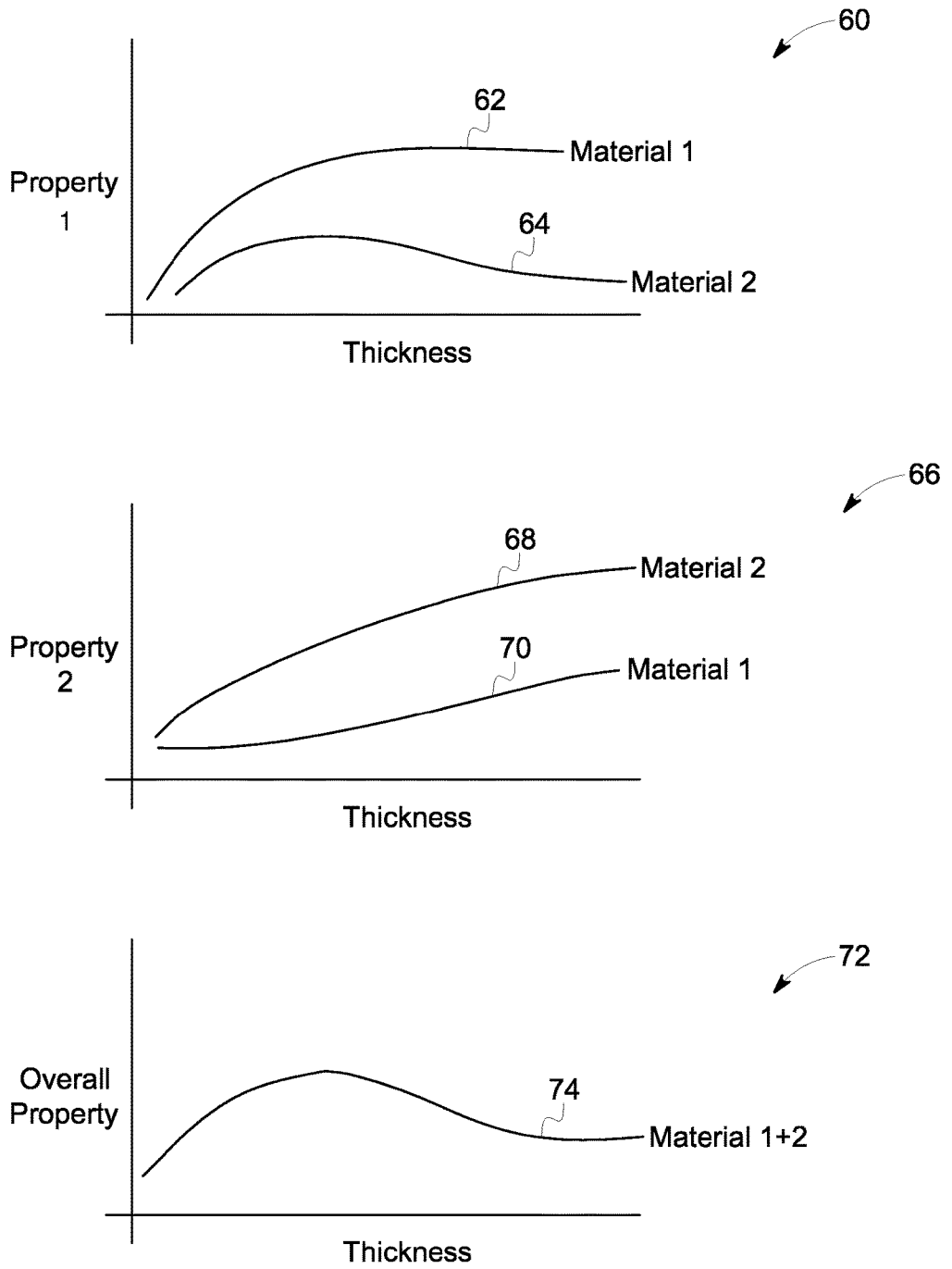
FIG. 4 is a diagram of graphs illustrating changes in different properties of target foils formed in accordance with various embodiments.

The method 50 further includes aligning or stacking the target foils in a determined order at 56. For example, as discussed in more detail herein, the foils may be stacked to provide individual or overall properties for use in connection with a particular isotope production system. As shown in the graphs 60 and 66 of FIG. 4, the thicknesses of the materials as illustrated by the curves 62 and 64 in graph 60 and the thicknesses of the materials as illustrated by the curves 68 and 70 in graph 66 may affect one or more properties of the foil. Additionally, when stacking the foils, an overall property as illustrated by the graph 72 may be affected by the thicknesses of the combined materials forming each of the foils as illustrated by the curve 74. Accordingly, using the graphs 60, 66 and 72, a determination may be made at to a desired thickness for each of the foils. Using a combination of different materials and different thickness for the foil members, particular properties may be defined. Additionally, using different combinations, and in one embodiment, at least one unexpected overall property is provided, such as a target window having the tensile strength for use in an isotope production system while providing almost a total reduction of long-lived isotopes in the target material (e.g., water). It should be noted that for some properties or materials, different sets of graphs for each of the properties are used to provide desired or required properties, but an overall property graph is not used.

The method 50 then includes positioning or orienting the multi-foil target window in an isotope production system at 58. For example, as described in more detail herein, one of the foils may be positioned towards a high energy particle entrance side and the other foil may be positioned toward a target material side.

Figure 5:
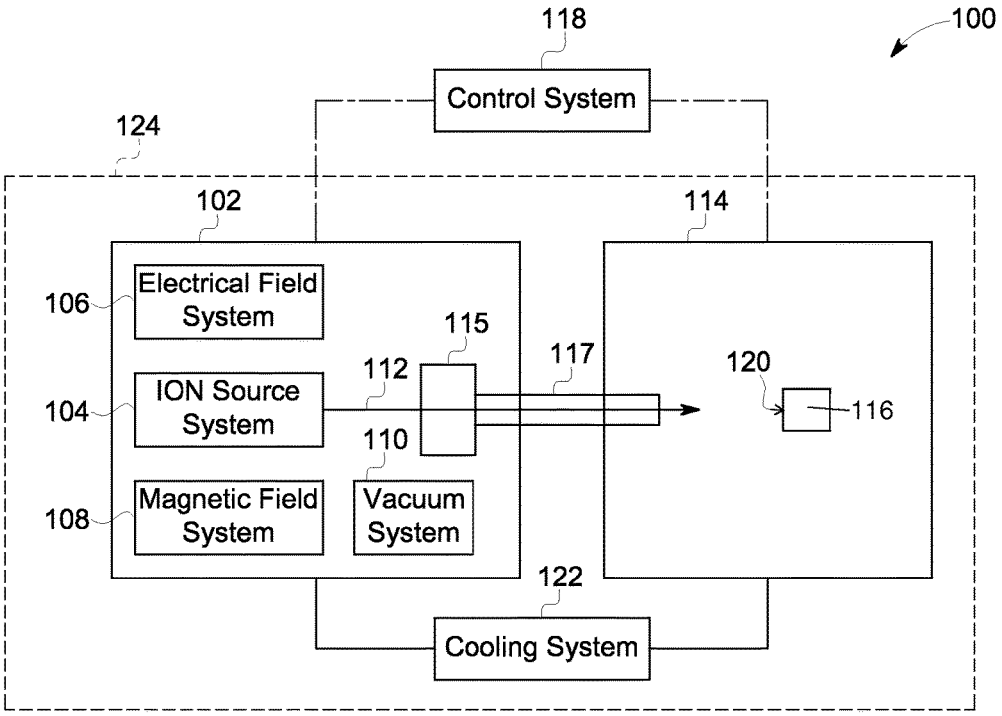
FIG. 5 is a block diagram of an isotope production system in which a target window formed in accordance with various embodiments may be implemented.
Figure 6:
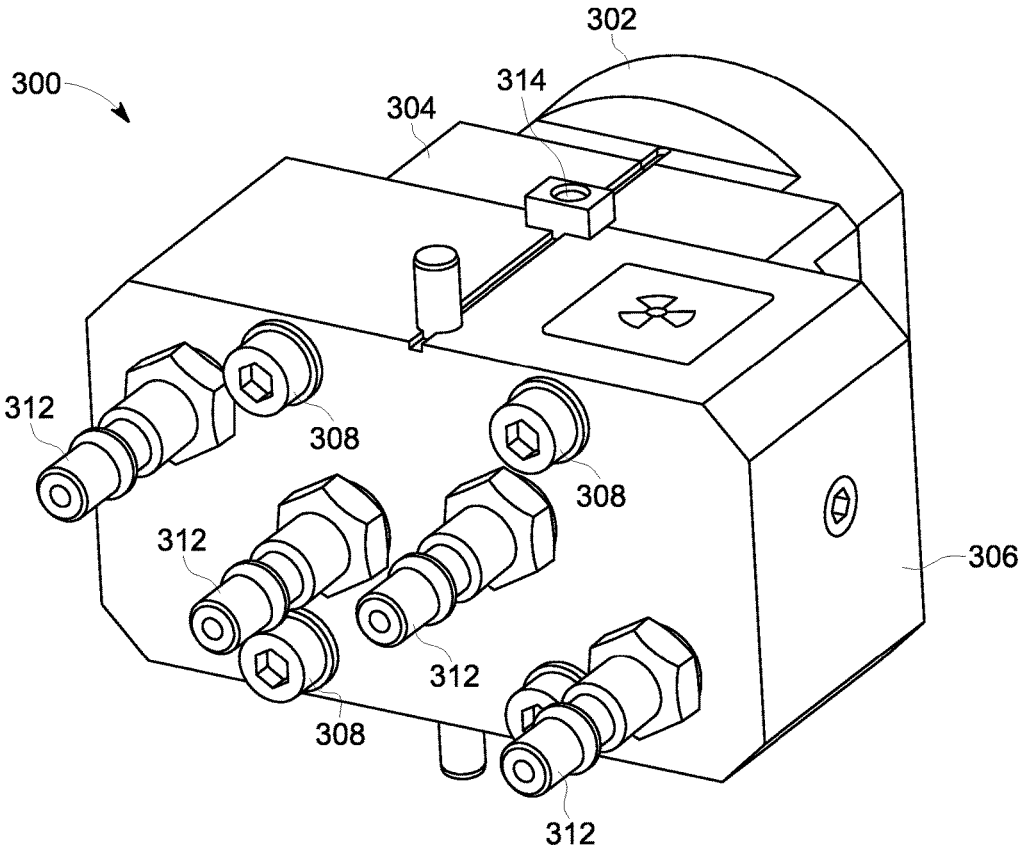
FIG. 6 is a perspective view of a target body for a target system formed in accordance with various embodiments.
Figure 7:
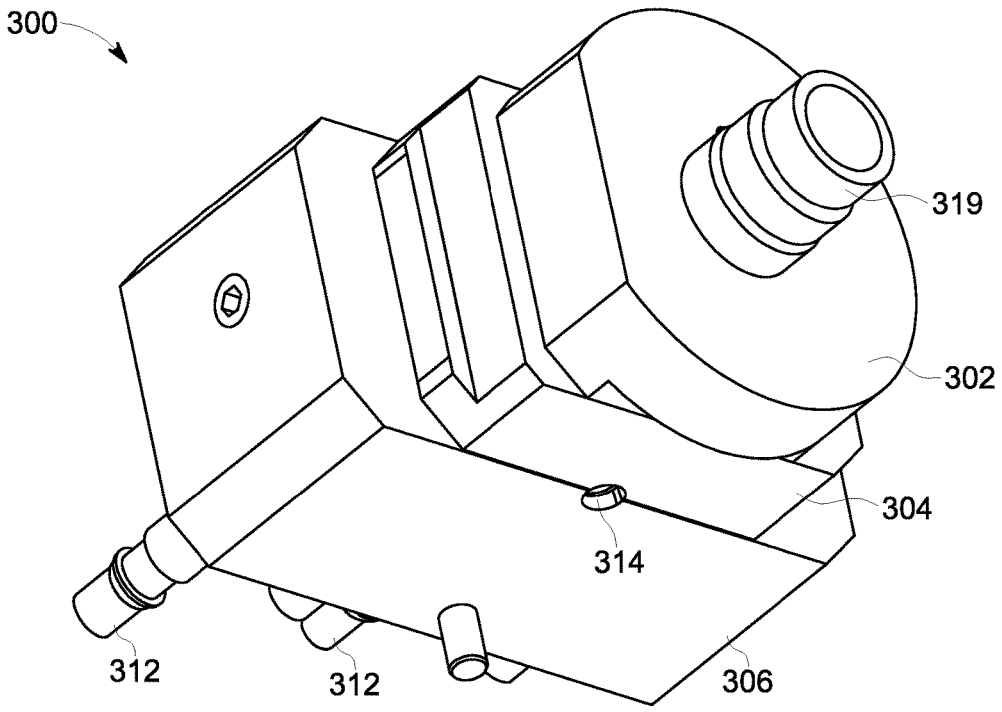
FIG. 7 is another perspective view of the target body of FIG. 6.

A target window formed in accordance with various embodiments may be used in different types and configurations of isotope production systems. For example, FIG. 5 is a block diagram of an isotope production system 100 formed in accordance with various embodiments in which a multi-foil target window may be provided. The system 100 includes a cyclotron 102 having several sub-systems including an ion source system 104, an electrical field system 106, a magnetic field system 108, and a vacuum system 110. During use of the cyclotron 102, charged particles are placed within or injected into the cyclotron 102 through the ion source system 104. The magnetic field system 108 and electrical field system 106 generate respective fields that cooperate with one another in producing a particle beam 112 of the charged particles.

Also shown in FIG. 5, the system 100 has an extraction system 115 and a target system 114 that includes a target material 116 (e.g., water). The target system 114 may be positioned inside, adjacent to or distance from an acceleration chamber of the cyclotron 102. To generate isotopes, the particle beam 112 is directed by the cyclotron 102 through the extraction system 115 along a beam transport path or beam passage 117 and into the target system 114 so that the particle beam 112 is incident upon the target material 116 located at a corresponding target location 120. When the target material 116 is irradiated with the particle beam 112, radiation from neutrons and gamma rays may be generated, which pass through the target window 20 (shown in FIG. 1).

It should be noted that in some embodiments the cyclotron 102 and target system 114 are not separated by a space or gap (e.g., separated by a distance) and/or are not separate parts. Accordingly, in these embodiments, the cyclotron 102 and target system 114 may form a single component or part such that the beam passage 117 between components or parts is not provided.

The system 100 may have one or more ports, for example, one to ten ports, or more. In particular, the system 100 includes one or more target locations 120 when one or more target materials 116 are located (one location 120 with one target material 116 is illustrated in FIG. 5). If multiple locations 120 are provided, a shifting device or system (not shown) may be used to shift the target locations with respect to the particle beam 112 so that the particle beam 112 is incident upon a different target material 116. A vacuum may be maintained during the shifting process as well. Alternatively, the cyclotron 102 and the extraction system 115 may not direct the particle beam 112 along only one path, but may direct the particle beam 112 along a unique path for each different target location 120 (if provided). Furthermore, the beam passage 117 may be substantially linear from the cyclotron 102 to the target location 120 or, alternatively, the beam passage 117 may curve or turn at one or more points there along. For example, magnets positioned alongside the beam passage 117 may be configured to redirect the particle beam 112 along a different path. It should be noted that although the various embodiments may be described in connection with a smaller cyclotron using smaller energies or beam currents, the various embodiments may be implemented in connection with larger cyclotrons having higher energies or beam currents.

Examples of isotope production systems and/or cyclotrons having one or more of the sub-systems are described in U.S. Pat. Nos. 6,392,246; 6,417,634; 6,433,495; and 7,122,966 and in U.S. Patent Application Publication No. 2005/0283199. Additional examples are also provided in U.S. Pat. Nos. 5,521,469; 6,057,655; 7,466,085; and 7,476,883. Furthermore, isotope production systems and/or cyclotrons that may be used with embodiments described herein are also described in co-pending U.S. patent application Ser. Nos. 12/492,200; 12/435,903; 12/435,949; and 12/435,931.

The system 100 is configured to produce radioisotopes (also called radionuclides) that may be used in medical imaging, research, and therapy, but also for other applications that are not medically related, such as scientific research or analysis. When used for medical purposes, such as in Nuclear Medicine (NM) imaging or PET imaging, the radioisotopes may also be called tracers. By way of example, the system 100 may generate protons to make different isotopes. Additionally, the system 100 may also generate protons or deuterons in order to produce, for example, different gases or labeled water.

It should be noted that the various embodiments may be implemented in connection with systems that have particles with any energy level as desired or needed. For example, various embodiments may be implemented in systems with any type of high energy particle, such as in connection with systems having accelerators that use very heavy and specific atoms for acceleration.

In some embodiments, the system 100 uses $^{1}H^{-}$ technology and brings the charged particles to a low energy (e.g., about 16.5 MeV) with a beam current of approximately 1-200 μA. In such embodiments, the negative hydrogen ions are accelerated and guided through the cyclotron 102 and into the extraction system 115. The negative hydrogen ions may then hit a stripping foil (not shown in FIG. 4) of the extraction system 115 thereby removing the pair of electrons and making the particle a positive ion, $^{1}H^{+}$. However, in alternative embodiments, the charged particles may be positive ions, such as $^{1}H^{+}$, $^{2}H^{+}$, and $^{3}He^{+}$. In such alternative embodiments, the extraction system 115 may include an electrostatic deflector that creates an electric field that guides the particle beam toward the target material 116. It should be noted that the various embodiments are not limited to use in lower energy systems, but may be used in higher energy systems, for example, up to 25 MeV and higher energy or beam currents. For example, the beam current may be approximately 5 μA to over approximately 200 μA.

The system 100 may include a cooling system 122 that transports a cooling or working fluid to various components of the different systems in order to absorb heat generated by the respective components. The system 100 may also include a control system 118 that may be used by a technician to control the operation of the various systems and components. The control system 118 may include one or more user-interfaces that are located proximate to or remotely from the cyclotron 102 and the target system 114. Although not shown in FIG. 5, the system 100 may also include one or more radiation and/or magnetic shields for the cyclotron 102 and the target system 114, as described in more detail below.

The system 100 may produce the isotopes in predetermined amounts or batches, such as individual doses for use in medical imaging or therapy. Accordingly, isotopes having different levels of activity may be provided. However, the isotopes may be produced in different quantities and in different ways. For example, the various embodiments may provide bulk isotope production, such that are larger amount of the isotope is produced and then specific amounts or individual doses are dispensed.

The system 100 may be configured to accelerate the charged particles to a predetermined energy level. For example, some embodiments described herein accelerate the charged particles to an energy of approximately 18 MeV or less. In other embodiments, the system 100 accelerates the charged particles to an energy of approximately 16.5 MeV or less. In particular embodiments, the system 100 accelerates the charged particles to an energy of approximately 9.6 MeV or less. In more particular embodiments, the system 100 accelerates the charged particles to an energy of approximately 8 MeV or less. Other embodiments accelerate the charged particles to an energy of approximately 18 MeV or more, for example, 20 MeV or 25 MeV. In still other embodiments, the charged particles may be accelerated to an energy of greater than 25 MeV.

The target system 114 includes a multi-foil target window within a target body 300 as illustrated in FIGS. 6 through 9. The target body 300 shown assembled in FIGS. 6 and 7 (and in exploded view in FIGS. 8 and 9) is formed from several components (illustrated as three components) defining an outer structure of the target body 300. In particular, the outer structure of the body 300 is formed from a housing portion 302 (e.g., a front housing portion or flange), a housing portion 304 (e.g., cooling housing portion or flange) and housing portion 306 (e.g., a rear housing portion or flange assembly). The housing portions 302, 304 and 306 may be, for example, sub-assemblies secured together using any suitable fastener, illustrated as a plurality of screws 308 each having a corresponding washer 310. The housing portions 302 and 306 may be end housing portions with the housing portion 304 being an intermediate housing portion. The housing portions 302, 304 and 306 form a sealed target body 300 having a plurality of ports 312 on a front surface of the housing portion 306, which in the illustrated embodiment operate as helium and water inlets and outlets that may be connected to helium and water supplies (not shown). Additionally, additional ports or openings 314 may be provided on top and bottom portions of the target body 300. The openings 314 may be provided for receiving fittings or other portions of a port therein.

Figure 8:
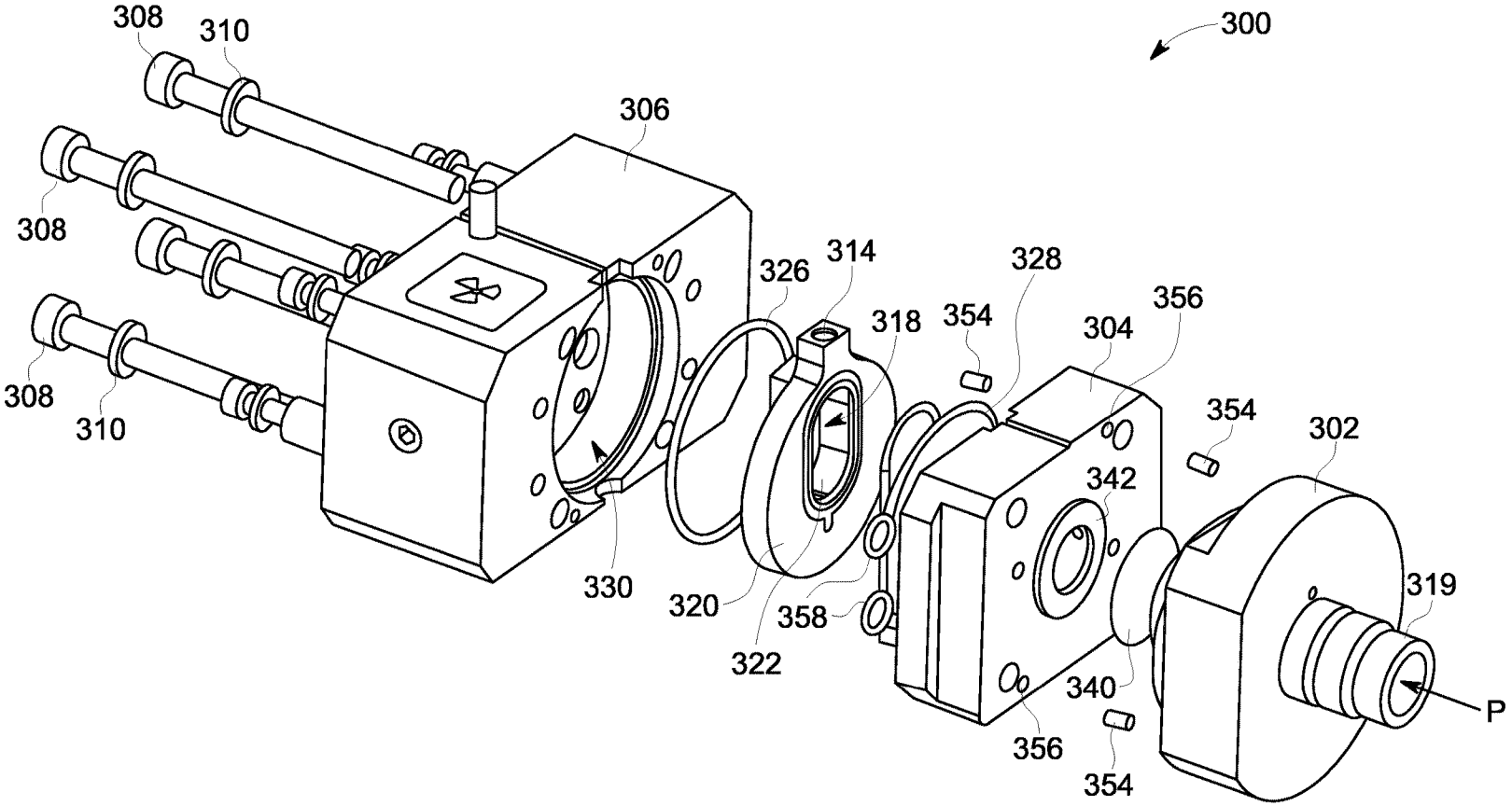
FIG. 8 is an exploded view of the target body of FIG. 6 showing components therein.
Figure 9:
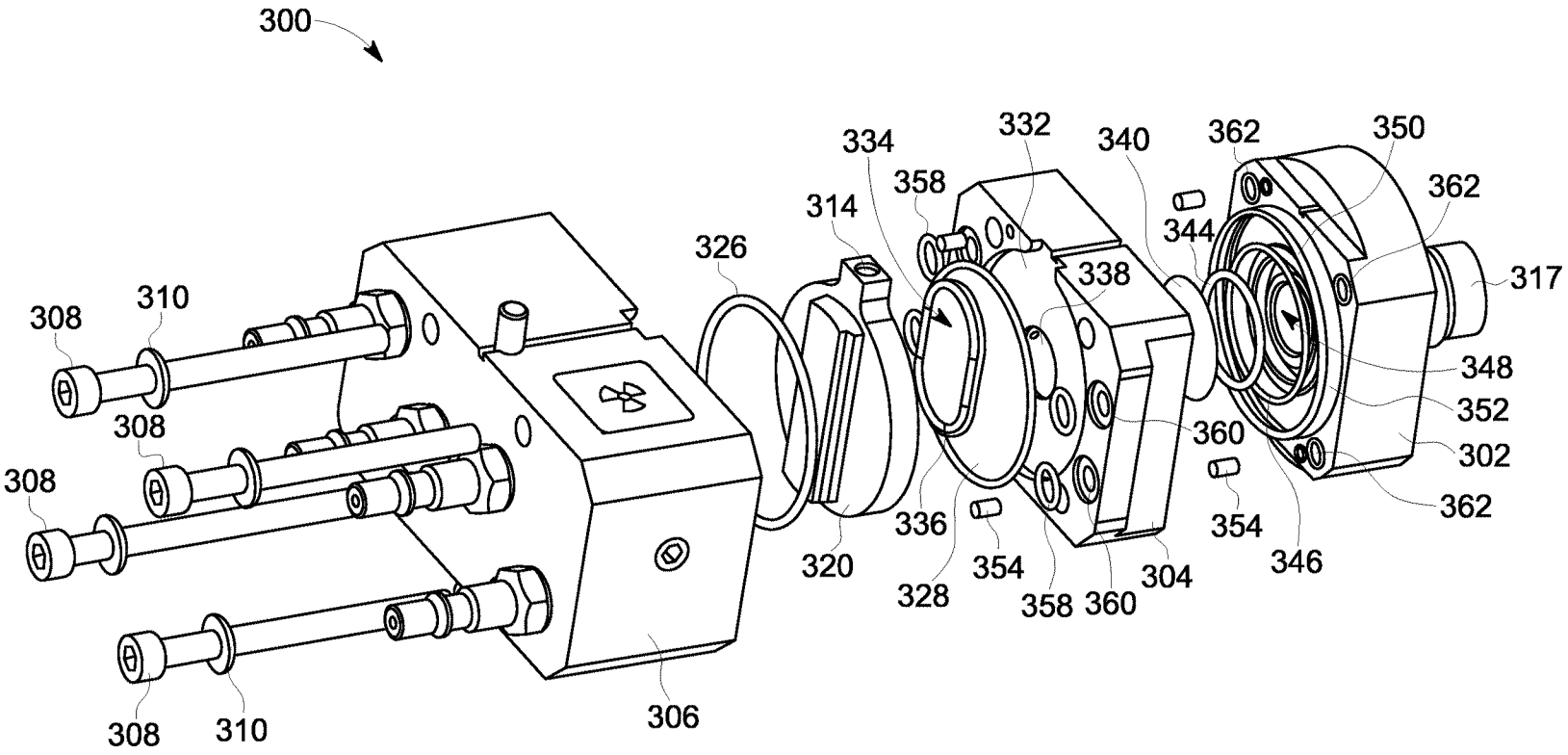
FIG. 9 is another exploded view of the target body of FIG. 6 showing components therein.

As described below, a passageway for the charged particle is provided within the target body 300, for example, a path for a proton beam that may enter the target body as illustrated by the arrow P in FIG. 8. The charged particles travel through the target body 300 from a tubular opening 319, which acts as a particle path entrance, to a cavity 318 (shown in FIG. 8) that is a final destination of the changed particles. The cavity 318 in various embodiments is water filled, for example, with about 2.5 milliliters (ml) of water, thereby providing a location for irradiated water ($H_2{}^{18}O$). In another embodiment, about 4 milliliters of $H_2{}^{16}O$ is used. The cavity 318 is defined within a body 320 formed, for example, from a Niobium material having a cavity 322 with an opening on one face. The body 320 includes the top and bottom openings 314 for receiving therein fittings, for example.

It should be noted that the cavity 318, in various embodiments, is filled with different liquids or with gas. In still other embodiments, the cavity 318 may be filled with a solid target, wherein the irradiated material is, for example, a solid, plated body of suitable material for the production of certain isotopes. However, it should be noted that when using a solid target or gas target, a different structure or design is provided.

The body 320 is aligned between the housing portion 306 and the housing portion 304 between a sealing ring 326 (e.g., an O-ring) adjacent the housing portion 306 and a multi-foil member 328, such as the target window 20 (shown in FIGS. 1 and 2), for example, a disc having one foil member formed from a heat treatable cobalt based alloy, such as Havar, and another foil member formed from an chemically inert material, such as Niobium, adjacent the housing potion 304. It should be noted that the housing portion 306 also includes a cavity 330 shaped and sized to receive therein the sealing ring 326 and a portion of the body 320. Additionally, the housing portion 306 includes a cavity 332 sized and shaped to receive therein a portion of the multi-foil member 328. The multi-foil member 328 may include a sealing border 336 (e.g., a Helicoflex border) configured to fit within the cavity 322 of the body 320, and the multi-foil member 328 is also aligned with an opening 338 to a passage through the housing portion 304.

Another foil member 340 optionally may be provided between the housing portion 304 and the housing portion 302. The foil member 340 may be referred to as a leading foil member because the proton beam is incident upon the foil member 340 prior to the multi-foil member 328. The foil member 340 may be a disc similar to the multi-foil member 328 or may include only a single foil member in some embodiments. The foil member 340 aligns with the opening 338 of the housing portion 304 having an annular rim 342 there around. A seal 344, a sealing ring 346 aligned with an opening 348 of the housing portion 302 and a sealing ring 350 fitting onto a rim 352 of the housing portion 302 are provided between the foil member 340 and the housing portion 302. It should be noted that more or less foil members or foil members may be provided. For example, in some embodiments only the foil member 328 is included and the foil member 340 is not included. Accordingly, different foil arrangements are contemplated by the various embodiments.

It should be noted that the foil members 328 and 340 are not limited to a disc or circular shape and may be provided in different shapes, configurations and arrangements. For example, the one or more the foil members 328 and 340, or additional foil members, may be square shaped, rectangular shaped, or oval shaped, among others. Also, it should be noted that the foil members 328 and 340 are not limited to being formed from particular materials as described herein.

As can be seen, a plurality of pins 354 are received within openings 356 in each of the housing portions 302, 304 and 306 to align these component when the target body 300 is assembled. Additionally, a plurality of sealing rings 358 align with openings 360 of the housing portion 304 for receiving therethrough the screws 308 that secure within bores 362 (e.g., threaded bores) of the housing portion 302.

During operation, as the proton beam passes through the target body 300 from the housing portion 302 into the cavity 318, the foil members 328 and 340 may be heavily activated (e.g., radioactivity induced therein). In particular, the foil members 328 and 340, which may be, for example, thin (e.g., 5-400 microns) foil alloy discs, isolate the vacuum inside the accelerator, and in particular the accelerator chamber and from the water in the cavity 322. The foil members 328 and 340 also allow cooling helium to pass therethrough and/or between the foil members 328 and 340. It should be noted that the foil members 328 and 340 have a thickness in various embodiments that allows a proton beam to pass therethrough, which results in the foil members 328 and 340 becoming highly radiated and which remain activated.

It should be noted that the housing portions 302, 304 and 306 may be formed from the same materials, different materials or different quantities or combinations of the same or different materials.

Embodiments described herein are not intended to be limited to generating radioisotopes for medical uses, but may also generate other isotopes and use other target materials. Also the various embodiments may be implemented in connection with different kinds of cyclotrons having different orientations (e.g., vertically or horizontally oriented), as well as different accelerators, such as linear accelerators or laser induced accelerators instead of spiral accelerators. Furthermore, embodiments described herein include methods of manufacturing the isotope production systems, target systems, and cyclotrons as described above.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the various embodiments, the various embodiments are by no means limiting and are exemplary embodiments. Many other embodiments will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments, including the best mode, and also to enable any person skilled in the art to practice the various embodiments, including making and using any devices or systems and performing any incorporated methods. The patentable scope of the various embodiments is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A target window for an isotope production system, the target window comprising:

a plurality of foil members including a first foil member comprising a high strength metal material and a second foil member comprising a chemically inert metal material, the plurality of foil members being positioned in a stacked arrangement such that corresponding sides of the first and second foil members engage each other or engage at least one other foil member of the plurality of foil members, the second foil member being positioned such that one of the corresponding sides of the second foil member is exposed to a target liquid during operation of the isotope production system, the second foil member impeding the transfer of long lived isotopes from the first foil member into the target liquid when a charged particle beam is incident on the plurality of foil members;

wherein the high strength metal material of the first foil member comprises Havar and the chemically inert metal material of the second foil member comprises Niobium, Tantalum, or Titanium, the plurality of foil members also including a third foil member positioned between the first and second foil members, the third foil member comprising aluminum or copper.

2. The target window in accordance with claim 1, wherein the first foil member is positioned such that a particle beam is incident on the first foil member before the other foil members of the plurality of foil members.

3. The target window in accordance with claim 1, wherein the high strength metal material of the first foil member has a tensile strength of at least 1000 MPa.

4. An isotope production system comprising:

an accelerator including an acceleration chamber; and a target system located inside, adjacent to, or a distance from the acceleration chamber, the accelerator configured to direct a charged particle beam from the acceleration chamber to the target system, the target system having:

a target body having a target cavity configured to encase a target liquid and having a passageway for the charged particle beam; and a target window comprising a plurality of foil members including a first foil member having a high strength metal material and a second foil member having a chemically inert metal material, wherein the plurality of foil members are positioned in a stacked arrangement such that corresponding sides of the first and second foil members engage each other or engage at least one other foil member of the plurality of foil members, the second foil member being positioned such that one of the corresponding sides of the second foil member is exposed to the target liquid during operation of the isotope production system, the second foil member positioned to impede the transfer of long lived isotopes from the first foil member into the target liquid when the charged particle beam is incident on the plurality of foil members and the target liquid, a housing portion having a receiving cavity that is defined by a rear face of the housing portion, the receiving cavity being sized and shaped to receive the plurality of foil members and the target body, the plurality of foil members being sandwiched between the rear face of the housing portion and a front face of the target body, each edge of the foil members being circumferentially surrounded by the target system, the second foil member engaging the front face of the target body.

5. The isotope production system in accordance with claim 4, wherein the first foil member is positioned such that a particle beam is incident on the first foil member before the other foil members of the plurality of foil members.

6. The isotope production system in accordance with claim 4, wherein the plurality of foil members further comprise a third foil member that includes a thermally conductive material, the third foil member being positioned between the first and second foil members.

7. The isotope production system in accordance with claim 4, wherein the high strength metal material of the first foil member comprises Havar, the chemically inert metal material of the second foil member comprising Niobium, Tantalum, or Titanium.

8. The isotope production system in accordance with claim 4, wherein the high strength metal material of the first foil member is a cobalt-based alloy that also comprises nickel, chromium, iron, tungsten, manganese, and molybdenum.

9. An isotope production system comprising:

an accelerator including an acceleration chamber; and a target system located inside, adjacent to, or a distance from the acceleration chamber, the accelerator configured to direct a charged particle beam from the acceleration chamber to the target system, the target system having:

a target body having a target cavity configured to hold a target liquid;

a target window comprising a plurality of foil members including a first foil member having a high strength metal material and a second foil member having a chemically inert metal material, wherein the plurality of foil members are positioned in a stacked arrangement such that corresponding sides of the first and second foil members engage each other or engage at least one other foil member of the plurality of foil members, the second foil member being positioned such that one of the corresponding sides of the second foil member is exposed to the target liquid during operation of the isotope production system, the second foil member positioned to impede the transfer of long lived isotopes from the first foil member into the target liquid when the charged particle beam is incident on the plurality of foil members and the target liquid; and first and second housing portions secured to one another with the target body therebetween, the first housing portion having a receiving cavity that is defined by a rear face of the first housing portion, the receiving cavity being sized and shaped to receive the plurality of foil members and a portion of the target body, the plurality of foil members being sandwiched between the rear face of the first housing portion and a front face of the target body, the first housing portion circumferentially surrounding each edge of the foil members, the second foil member engaging the front face of the target body.

10. The isotope production system in accordance with claim 9, wherein the first foil member is positioned toward the high energy particle entrance side and the second foil member engages the target liquid during operation of the isotope production system, wherein a pressure force is exerted on the plurality of foil members in a direction from the target liquid toward the accelerator.

11. The isotope production system in accordance with claim 10, wherein the target system further comprises a leading foil member that is positioned between the plurality of foil members and the accelerator, the target system including a cooling chamber that exists between the leading foil member and the plurality of foil members.

12. The target window in accordance with claim 1, wherein the plurality of foil members are discrete foil members and are sandwiched together such that each side of each foil member engages an adjacent foil member if an adjacent foil member exists.

13. The target window in accordance with claim 12, wherein the at least one third foil member is only a single third foil member, each of the first and second foil members engaging the third foil member.

14. The isotope production system of claim 4, wherein the high strength metal material of the first foil member is configured to support the second foil member as the second foil member experiences pressure during operation of the isotope production system.

15. The isotope production system in accordance with claim 14 wherein the high strength metal material of the first foil member is configured to support the second foil member as the second foil member experiences pressure during operation of the isotope production system, wherein the high strength metal material of the first foil member is a cobalt based alloy that also comprises nickel, chromium, iron, tungsten, manganese, and molybdenum.

16. The isotope production system in accordance with claim 14 wherein the high strength metal material of the first foil member has a tensile strength of at least 1000 MPa and a melting point of at least 1200 degrees Celsius.

17. The isotope production system in accordance with claim 16 wherein the chemically inert metal material of the second foil member comprises at least one of Niobium, Titanium, or Tantalum, the plurality of foil members also including a third foil member positioned between the first and second foil members, the third foil member comprising a material that has a greater thermal conductivity than a thermal conductivity of the first foil member or a thermal conductivity of the second foil member, a thickness of the third foil member being greater than a thickness of the first foil member and a thickness of the second foil member, wherein the third foil member is configured to absorb thermal energy from the first and second foil members and transfer the thermal energy away from the passageway into the body of the target system.

18. The isotope production system of claim 4, further comprising a leading foil member that is positioned in front of and spaced apart from the plurality of foil members, the target system including a cooling chamber that exists between the leading foil member and the plurality of foil members, wherein the plurality of foil members are discrete foil members and are sandwiched together such that each side of each foil member of the plurality of foil members engages an adjacent foil member if an adjacent foil member exists.

19. The isotope production system in accordance with claim 9, wherein the high strength metal material of the first foil member comprises Havar and the chemically inert metal material of the second foil member comprises Niobium, Tantalum, or Titanium.

20. The isotope production system of claim 4, wherein the high strength metal material of the first foil member comprises a cobalt-based alloy and the chemically inert metal material of the second foil member comprises Niobium, Tantalum, or Titanium, the plurality of foil members also including a third foil member positioned between the first and second foil members, the third foil member comprising a material that has a greater thermal conductivity than a thermal conductivity of the first foil member or a thermal conductivity of the second foil member, a thickness of the third foil member being greater than a thickness of the first foil member and a thickness of the second foil member.

21. The isotope production system of claim 20, wherein the third foil member is configured to absorb thermal energy from the first and second foil members and transfer the thermal energy away from the passageway into the body of the target system.

22. The isotope production system of claim 9, wherein the plurality of foil members in the stacked arrangement form a multi-foil member, the isotope production system further comprising a sealing border that engages the multi-foil member, the sealing border being disposed within the receiving cavity.

23. The isotope production system of claim 9, wherein the first and second housing portions circumferentially surround an outer surface of the target body.

* * * * *